US008872313B2

(12) United States Patent
Ushio et al.

(10) Patent No.: US 8,872,313 B2
(45) Date of Patent: Oct. 28, 2014

(54) PACKAGE APPARATUS OF POWER SEMICONDUCTOR DEVICE

(75) Inventors: Takayuki Ushio, Chiyoda-ku (JP); Yoshihisa Oguri, Chiyoda-ku (JP); Akira Goto, Chiyoda-ku (JP); Jyunya Kanazawa, Shibuya-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 428 days.

(21) Appl. No.: 13/322,336

(22) PCT Filed: May 26, 2009

(86) PCT No.: PCT/JP2009/059614

§ 371 (c)(1),
(2), (4) Date: Nov. 23, 2011

(87) PCT Pub. No.: WO2010/137116

PCT Pub. Date: Dec. 2, 2010

(65) Prior Publication Data

US 2012/0074543 A1 Mar. 29, 2012

(51) Int. Cl.
*B65D 81/113* (2006.01)
*B65D 5/50* (2006.01)
*B65D 85/38* (2006.01)

(52) U.S. Cl.
CPC ..... *B65D 5/5061* (2013.01); *B65D 85/38* (2013.01)
USPC ..... 257/659; 257/E23.114

(58) Field of Classification Search
CPC .. B65D 81/113; H01L 31/042; H01L 23/552; H01L 23/556; H01L 23/564; H01L 23/60; H01L 23/62
USPC ..... 257/659, E23.114
See application file for complete search history.

(56) References Cited

U.S. PATENT DOCUMENTS

| | | | | |
|---|---|---|---|---|
| 5,131,535 | A | 7/1992 | O'Connor et al. | |
| 5,335,771 | A * | 8/1994 | Murphy | 206/725 |
| 5,597,074 | A | 1/1997 | Ko | |
| 7,425,757 | B2 | 9/2008 | Takubo | |

(Continued)

FOREIGN PATENT DOCUMENTS

| | | | |
|---|---|---|---|
| CN | 1638116 | A | 7/2005 |
| CN | 2837217 | Y | 11/2006 |
| CN | 101156249 | A | 4/2008 |
| DE | 19500743 | A1 | 10/1995 |

(Continued)

OTHER PUBLICATIONS

Japanese Office Action dated Mar. 5, 2013, issued in corresponding Japanese Patent Application No. 2011-515775. (3 pages).

(Continued)

*Primary Examiner* — Selim Ahmed
(74) *Attorney, Agent, or Firm* — Buchanan Ingersoll & Rooney PC

(57) ABSTRACT

A package apparatus is for packaging a power semiconductor device that includes a substrate formed, a mold part molded on the substrate, and electrode terminals extended from the mold part to a side opposite from the substrate by a predetermined length; includes: a holding unit that has insertion slots and is to holding the power semiconductor device, the insertion slots each being an opening into which the power semiconductor device is insertable in a direction perpendicular to extending direction of the electrode, edges of the opening being formed to make contact with the mold part and the substrate; and a container box that contains the holding unit. The insertion slots are provided to the holding unit so that an interval between the insertion slots in an extending direction of the electrode terminals of the power semiconductor device inserted is greater than the extending length of the electrode terminals.

7 Claims, 7 Drawing Sheets

(56) References Cited

U.S. PATENT DOCUMENTS

| | | | | |
|---|---|---|---|---|
| 2005/0156251 | A1* | 7/2005 | Takubo | 257/401 |
| 2008/0251114 | A1* | 10/2008 | Tanaka et al. | 136/251 |

FOREIGN PATENT DOCUMENTS

| | | | |
|---|---|---|---|
| DE | 29715960 | U1 | 1/1998 |
| JP | 4-154542 | A | 5/1992 |
| JP | 2003-26244 | A | 1/2003 |
| JP | 2005-14965 | A | 1/2005 |
| JP | 2005-243971 | A | 9/2005 |
| JP | 2006-245362 | A | 9/2006 |
| JP | 2008-184180 | A | 8/2008 |

OTHER PUBLICATIONS

English Translation of the Written Opinion of the International Searching Authority (Form PCT/ISA/237) issued on Jul. 21, 2009, in the corresponding International Application No. PCT/JP2009/059614. (5 pages).

Chinese Office Action dated Mar. 1, 2013, issued in corresponding Chinese Patent Application No. 2009801594822, and English language translation of Office Action. (15 pages).

International Search Report (PCT/ISA/210) issued on Jul. 21, 2009, by Japanese Patent Office as the International Searching Authority for International Application No. PCT/JP2009/059614.

Written Opinion (PCT/ISA/237) issued on Jul. 21, 2009, by Japanese Patent Office as the International Searching Authority for International Application No. PCT/JP2009/059614.

Office Action from German Patent Office dated Dec. 5, 2012, issued in corresponding German Patent Appln. No. 112009004797.1, with English translation thereof (10 pages).

* cited by examiner

PACKAGE APPARATUS OF POWER SEMICONDUCTOR DEVICE

FIELD

The present invention relates to a package apparatus for packaging a power semiconductor device for transportation.

BACKGROUND

A conventional package apparatus of a power semiconductor device has the structure that a package box includes partitions for accommodating power semiconductor devices, and power semiconductor devices are placed flat or upright inside the partitions.

There is a conventional package box that is formed by folding a piece of corrugated cardboard, and a base part holds the corners of power semiconductor devices so as to leave gaps to the side plates and terminal parts of the articles to be packaged (for example, see Patent Literature 1).

There is also a conventional package box that is formed by folding a piece of corrugated cardboard, in which space is created around an article to be contained to provide a buffer function for the accommodated article (for example, see Patent Literature 2).

CITATION LIST

Patent Literature

Patent Literature 1: Japanese Patent Application Laid-open No. 2008-184180

Patent Literature 2: Japanese Patent Application Laid-open No. 2005-14965

SUMMARY

Technical Problem

Although the foregoing conventional technologies are to fold a piece of corrugated cardboard, the corrugated cardboard used is large in area, which increases the package weight. There have thus been the problems of high package material cost and high transportation cost, as well as large man-hours for folding and assembly operations.

According to the foregoing conventional technologies, the accommodated article(s) is/are surrounded by an impact buffer space for protecting the accommodated article(s) from impact due to dropping and the like during transportation. If the accommodated article(s) has/have high impact acceleration tolerance to various types of impact and the buffer space ends up being excessive packaging, such buffer space is wasteful in terms of transportation and in terms of storage and cargo handling.

The present invention has been achieved in view of the foregoing, and it is an object thereof to provide a package apparatus that can suppress logistic cost by shrinking the packing volume and reducing the package weight while protecting fragile portions such as electrode terminals from drop impact during transportation and cargo handling, vibration impact during transportation, and compressive load during transportation and storage.

Solution to Problem

In order to solve the aforementioned problems and attain the aforementioned object, the package apparatus of a power semiconductor device for packaging a power semiconductor device that includes a substrate formed in a square shape, a mold part molded on the substrate in a square thick plate-like shape, and a plurality of electrode terminals extended from the mold part to a side opposite from the substrate by a predetermined length, the package apparatus is provided with: a holding unit that has a plurality of insertion slots and is configured to be capable of holding the power semiconductor device, the insertion slots each being an opening into which the power semiconductor device is insertable in a direction generally perpendicular to an extending direction of an electrode, edges of the opening being formed so as to make contact with the mold part and the substrate; and a container box that contains the holding unit, the plurality of insertion slots being provided to the holding unit so that an interval between the plurality of insertion slots in an extending direction of the electrode terminals of the power semiconductor device inserted is greater than the extending length of the electrode terminals.

Advantageous Effects of Invention

According to the package apparatus of a power semiconductor device of the present invention, the opening edges of the insertion slots make contact with the mold parts of power semiconductor devices. This can make the mold parts serve as a rigid member of the package apparatus, allowing compact packing volume and lighter package weight. Moreover, since the interval between the insertion slots is greater than the extending length of the electrode terminals, it is less likely for the electrode terminals to make contact with other power semiconductor devices and the like. This has the effect of enhanced protection against impact during transportation and cargo handling.

DESCRIPTION OF EMBODIMENTS

Hereinafter, embodiments of the package apparatus of a power semiconductor device according to the present invention will be described in detail with reference to the drawings. It should be noted that the present invention is not limited by these embodiments.

First Embodiment

Figure 1:
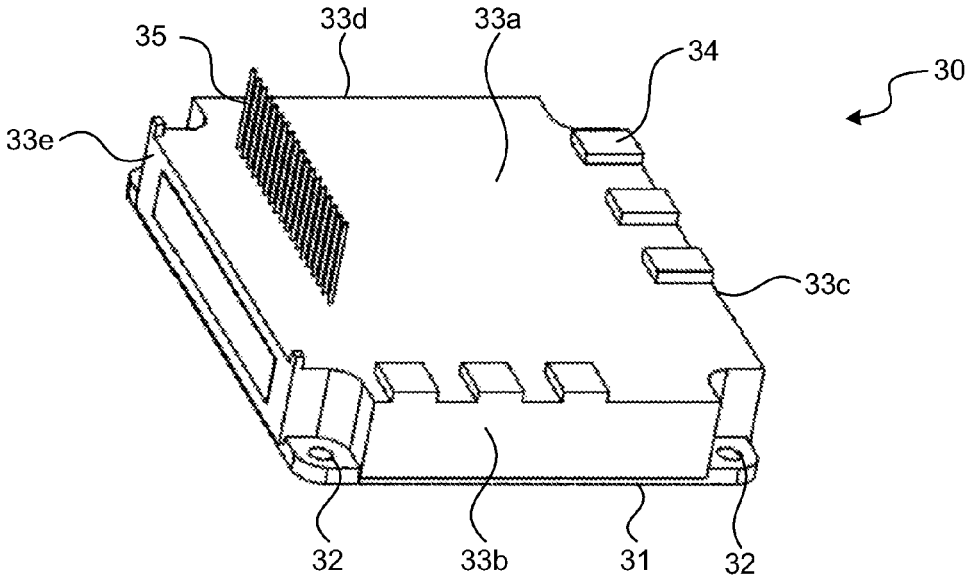
FIG. 1 is a perspective view showing the outside shape of a power semiconductor device.
Figure 2:
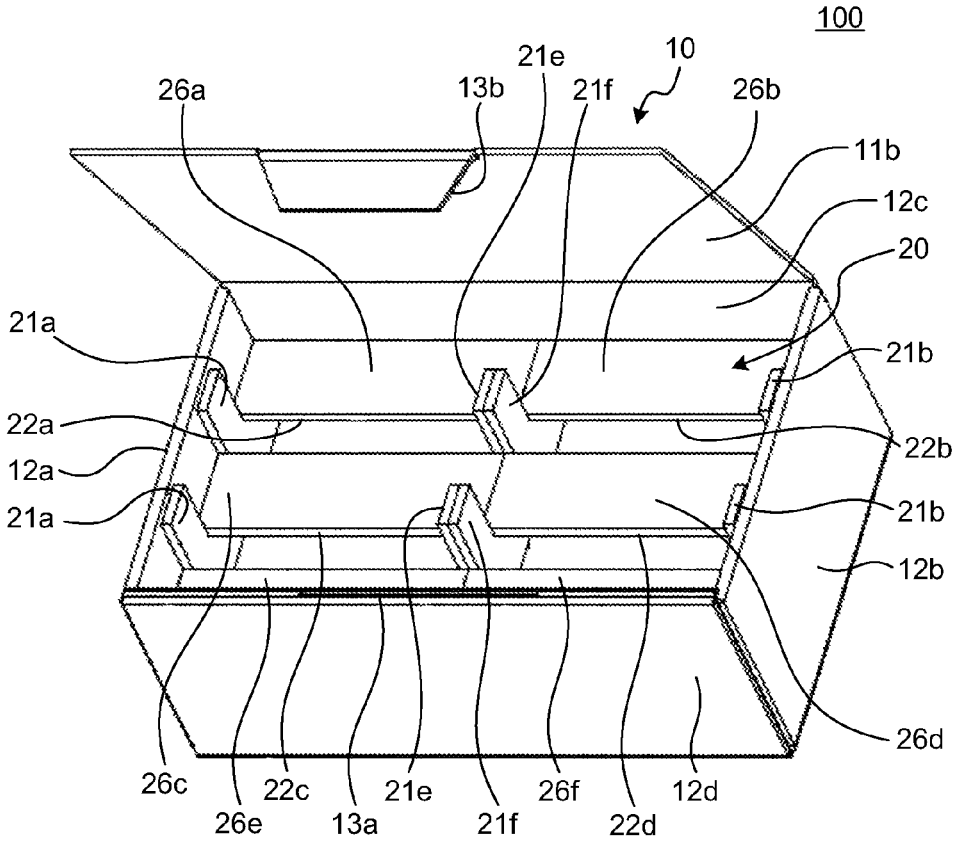
FIG. 2 is a perspective view showing a package apparatus of a power semiconductor device according to the present first embodiment.
Figure 3:
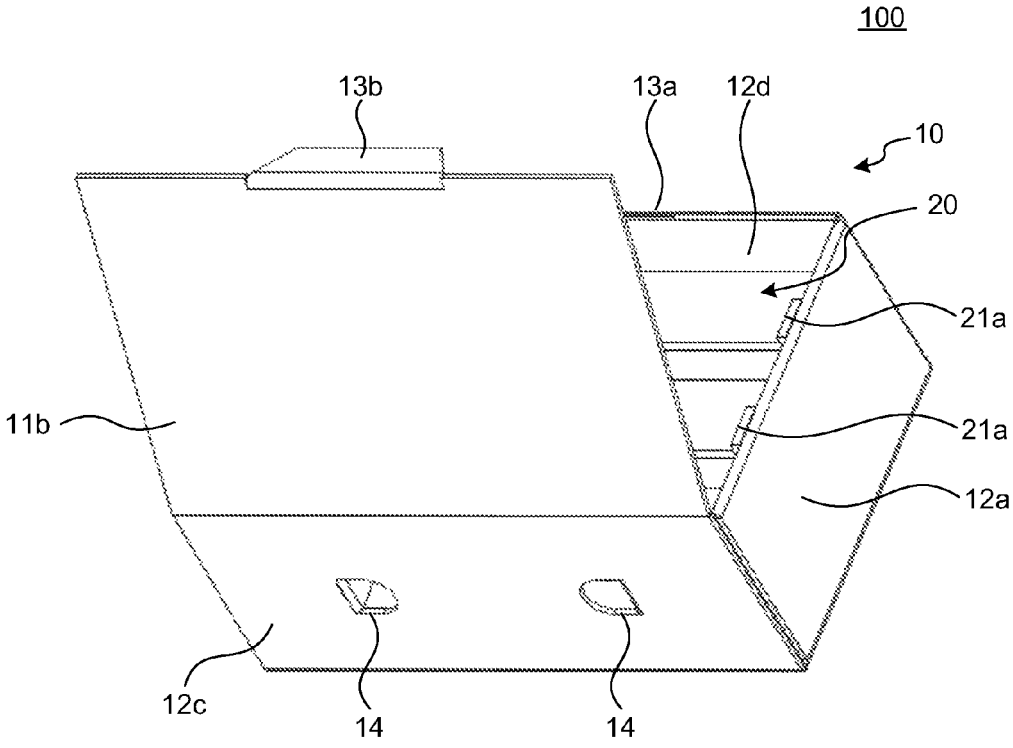
FIG. 3 is a perspective view of the package apparatus shown in FIG. 2, seen from the rear side.
Figure 4:
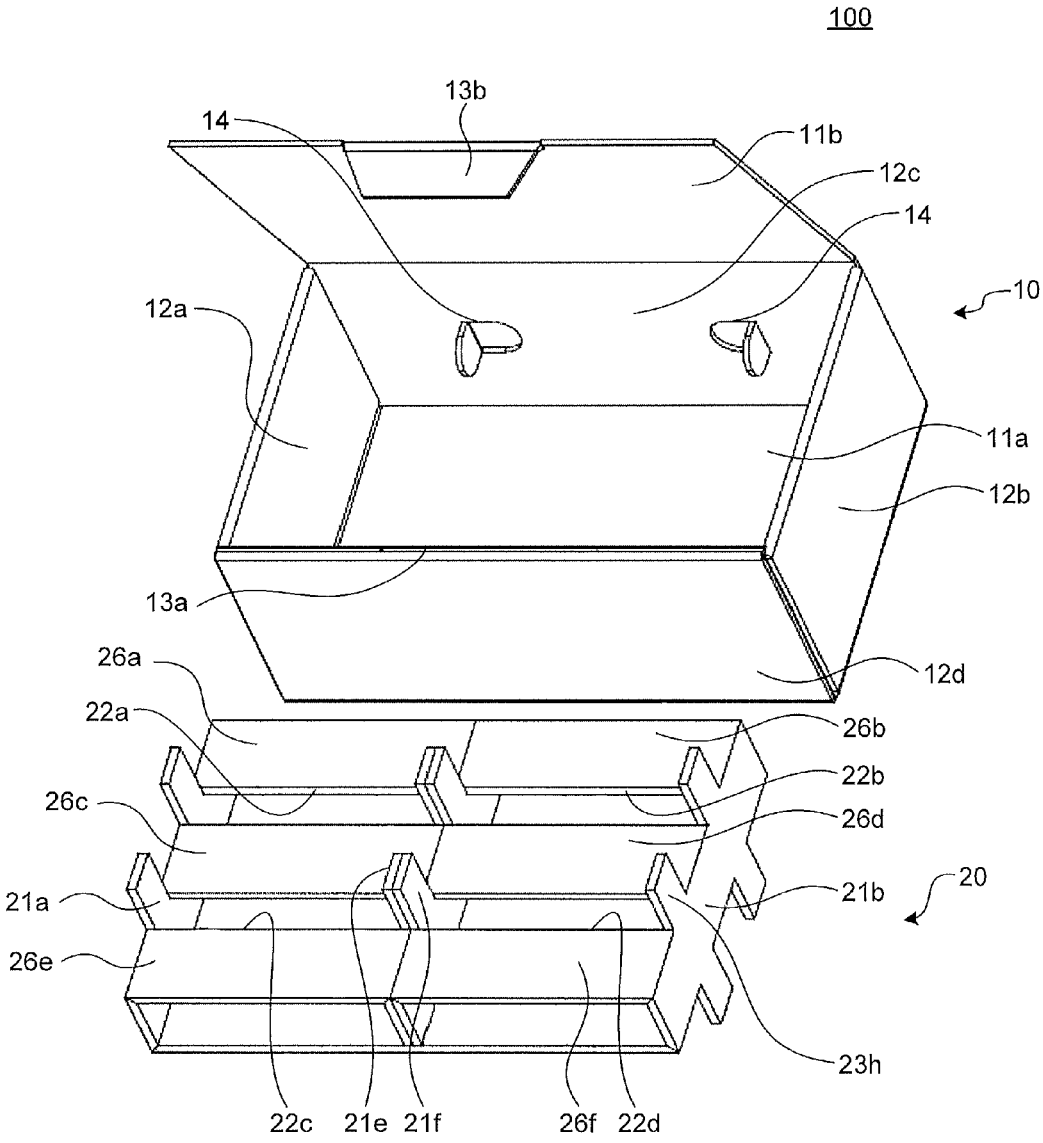
FIG. 4 is an exploded view of the package apparatus.
Figure 5:
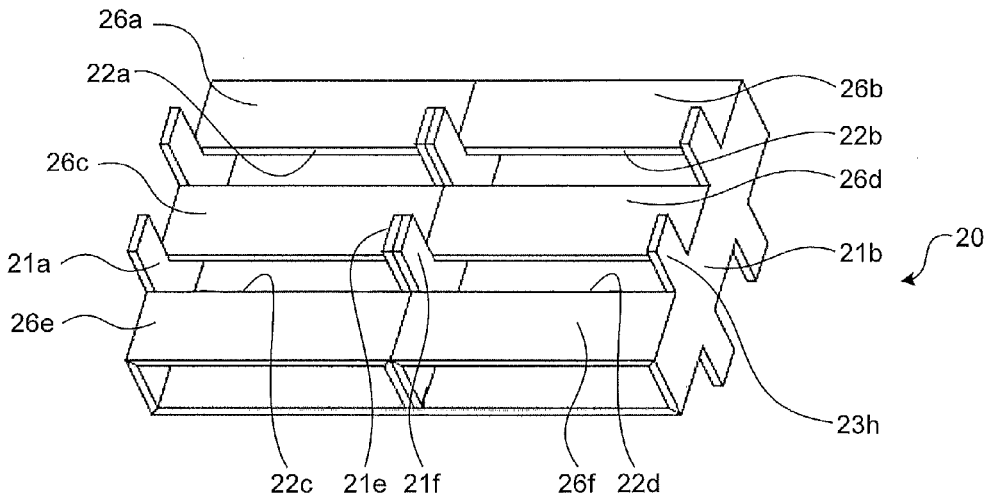
FIG. 5 is a perspective view of a holding unit of a power semiconductor device.
Figure 6:
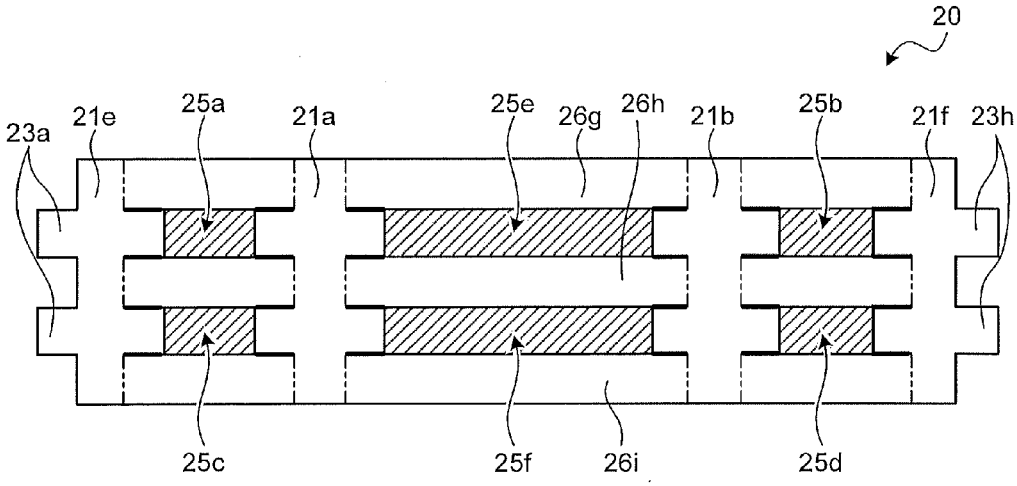
FIG. 6 is a developed view of the holding unit shown in FIG. 5.
Figure 7:
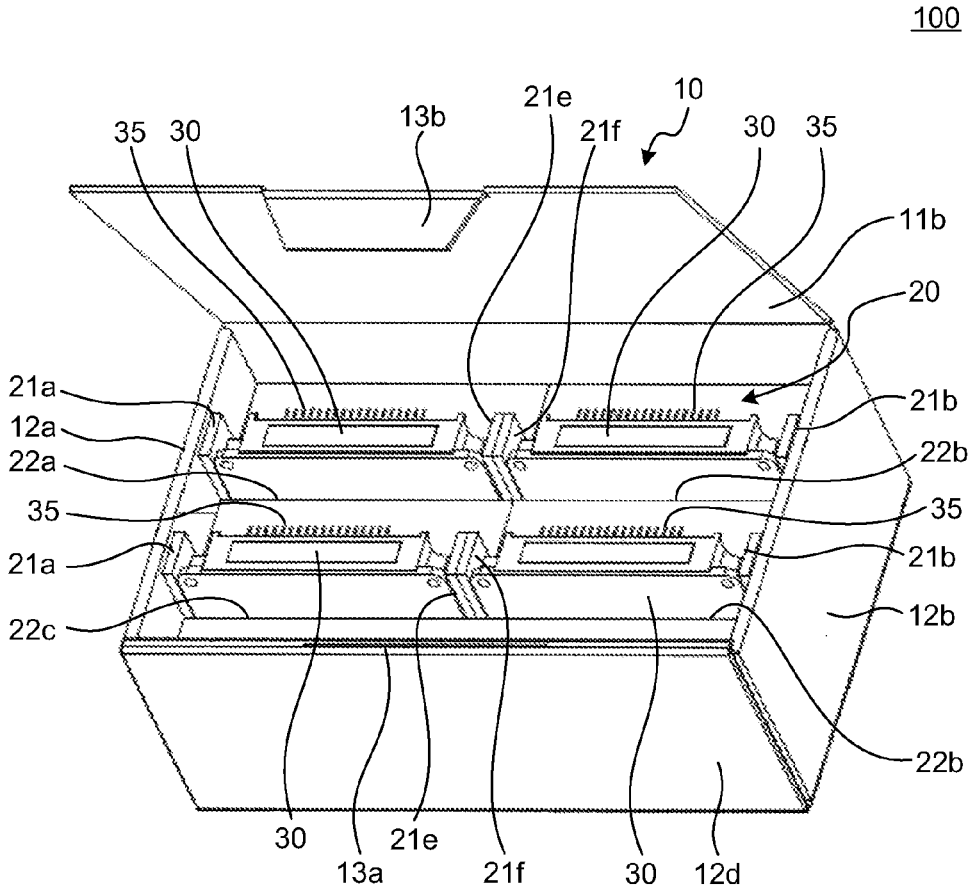
FIG. 7 is a perspective view showing power semiconductor devices being contained in the package apparatus.

FIG. 1 is a perspective view showing the outside shape of a power semiconductor device. FIG. 2 is a perspective view showing a package apparatus of a power semiconductor device according to a first embodiment of this invention. FIG. 3 is a perspective view of the package apparatus shown in FIG. 2, seen from the rear side. FIG. 4 is an exploded view of the package apparatus. FIG. 5 is a perspective view of a holding unit of a power semiconductor device. FIG. 6 is a developed view of the holding unit shown in FIG. 5. FIG. 7 is a perspective view showing power semiconductor devices being contained in the package apparatus.

FIG. 1 is a perspective view of the outside shape of a power semiconductor device 30 which is an article to be contained according to the present invention. The power semiconductor device 30 includes a substrate 31 which is formed in a square plate-like shape and has mounting holes 32 in four corners, and a mold part 33 which is molded on the substrate 31 in a square thick plate-like shape. The mold part 33 has an electrode face 33*a* which is the surface opposite from the substrate 31, and peripheral surfaces 33*b*, 33*c*, 33*d*, and 33*e*. The electrode face 33*a* is provided with a plurality of electrode terminals 34 and 35 which are extended by predetermined lengths. The entire power semiconductor device 30 is formed in a square thick plate-like shape. It should be noted that the power semiconductor device 30 shown in FIG. 1 shows just an example of the shape of the power semiconductor device. The power semiconductor device is not limited to the shape shown in FIG. 1.

As shown in FIGS. 2 and 3, a package apparatus 100 of a power semiconductor device includes a container box 10 and a holding unit 20 of power semiconductor devices 30. A bottom plate 11*a* and peripheral wall plates 12*a* to 12*d* of the container box 10 create an internal space for accommodating power semiconductor devices 30. The peripheral wall plate 12*c* is provided with a lid 11*b*. An insert tab 13*b* is inserted into an insertion slot 13*a* to enclose the internal space so that power semiconductor devices 30 are contained.

FIG. 4 shows an exploded view of the package apparatus 100. The package apparatus 100 includes the container box 10 and the holding unit 20 of power semiconductor devices 30. FIG. 5 shows the holding unit 20 of power semiconductor devices 30. FIG. 6 shows a developed view of the holding unit 20.

As shown in FIG. 6, the holding unit 20 is made of a piece of corrugated cardboard. Hatched portions 25*a* to 25*f* shown hatched are cut away from the single piece of corrugated cardboard. Cuts are made into the portions shown by the thick lines. The corrugated cardboard with the hatched portions 25*a* to 25*f* cut off is folded along the double-dotted broken lines. Ends 23*a* and 23*h* are inserted into where the hatched portions 25*e* and 25*f* are cut off, whereby the holding unit 20 is set up. This holding unit 20 is contained in the container box 10 to constitute the package apparatus 100. The openings formed by cutting the hatched portions off are insertion slots 22*a*, 22*b*, 22*c*, and 22*d* for power semiconductor devices 30 to be inserted into. After the setup of the holding unit 20, mutually opposite side plates 21*e* and 21*a* are linked by interval maintaining plates 26*a*, 26*c*, and 26*e*. Mutually opposite side plates 21*f* and 21*b* are linked by interval maintaining plates 26*b*, 26*d*, and 26*f*. The side plates 21*a* and 21*b* are also linked by interval maintaining plates 26*g*, 26*h*, and 26*i*. The side plates 21*a*, 21*b*, 21*e*, and 21*f*, and the interval maintaining plates 26*a* to 26*i* will be described in detail later.

FIG. 7 is an example of embodiment where four power semiconductor devices 30 are contained in the package apparatus 100. The power semiconductor devices 30 are held with their mold parts 33 inserted in the insertion slots 22*a* to 22*d* in a direction perpendicular to the extending direction of the electrode terminals 34 and 35. In the power semiconductor devices 30 being held, the side plates 21*a*, 21*b*, 21*e*, and 21*f* which constitute part of the opening edges of the insertion slots 22*a* to 22*d* make contact with the peripheral surfaces 33*b* and 33*d* of the mold parts 33 from both sides. The interval maintaining plates 26*a* to 26*i* which constitute part of the opening edges of the insertion slots 22*a* to 22*d* make contact with the substrates 31 or electrode faces 33*a* of the power semiconductor devices 30.

That is, the contact of the opening edges of the insertion slots 22*a* to 22*d* with the mold parts 33 and substrates 31 of the power semiconductor devices 30, can make the mold parts 33 and the substrates 31 serve as a rigid member of the package apparatus 100. As a result, it is possible to constitute the package apparatus with a smaller amount of package material than heretofore. Long slender electrode terminals such as the electrode terminals 35 are prone to bending because of external force. It is therefore difficult to make such electrode terminals function as a rigid member like the mold parts 33. This requires protection from external force that acts on the package apparatus during transportation and cargo handling.

Then, the insertion slots 22*a* to 22*d* are formed in the holding unit 20 so that the interval between the insertion slots 22*a* to 22*d* in the extending direction of the electrode terminals 35 of the power semiconductor devices 30 that are inserted and held in the insertion slots 22*a* to 22*d* is greater than the extending length of the electrode terminals 35. Specifically, the interval maintaining plates 26*a* to 26*i* are formed with a width greater than the extending length of the electrode terminals, whereby the interval between the insertion slots 22*a* to 22*d* is maintained. This can prevent the electrode terminals 35 of the power semiconductor devices 30 held by the holding unit 20 from making contact with or colliding with the other semiconductor devices 30 and the like, thereby allowing enhanced protection against impact during transportation and cargo handling.

Since the package apparatus 100 according to the present first embodiment is thus simplified in the package structure of the holding unit 20, it is possible to reduce the packing volume and package weight for suppressed transportation cost. Since the holding unit 20 is made of a single piece of corrugated cardboard, it is possible to reduce the paper cost and simplify the assembly work for suppressed package cost.

Figure 8:
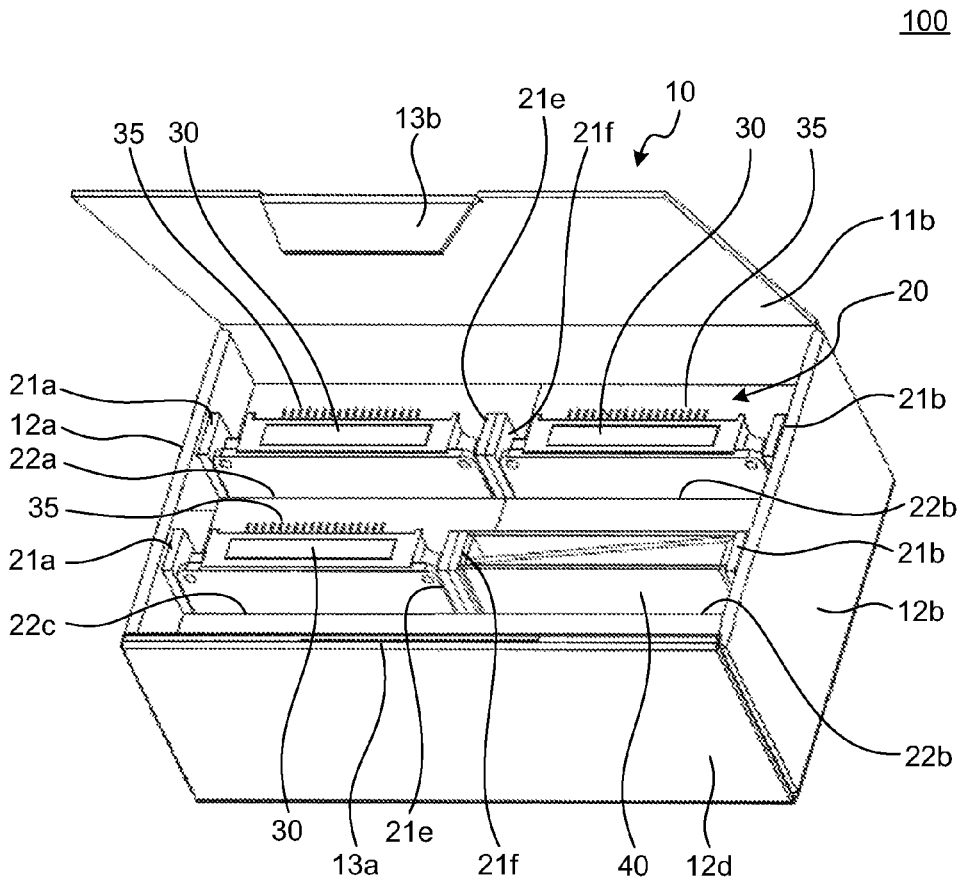
FIG. 8 is a diagram showing the package apparatus that contains three power semiconductor devices.
Figure 9:
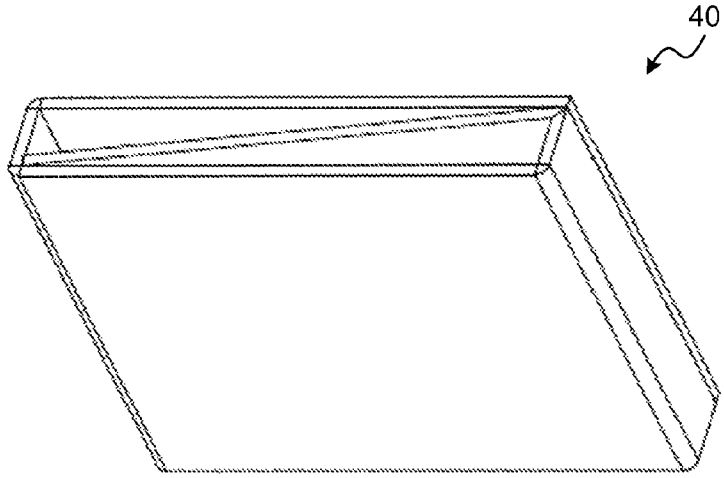
FIG. 9 is a perspective view of a spacer.

FIG. 8 is a diagram showing the package apparatus 100 that contains three power semiconductor devices 30. FIG. 9 is a perspective view of a spacer to be used in any of the insertion slots 22*a*, 22*b*, 22*c*, and 22*d* where no power semiconductor device 30 is inserted. A spacer 40 has generally the same outer dimensions as those of a power semiconductor device 30.

As described above, the package apparatus 100 of a power semiconductor device 30 attains the rigidity of the entire package apparatus 100 by utilizing the rigidity that the power semiconductor device 30 itself has. In the present first embodiment, the holding unit 20 has the four insertion slots 22*a* to 22*d*, and it is difficult to provide sufficient rigidity if power semiconductor devices 30 are not inserted in all the insertion slots. If the number of power semiconductor devices 30 contained in the package apparatus 100 is not the intended number, like two or three, then the spacer 40 shown in FIG. 8 is inserted into the insertion slot(s) 22*a* to 22*d* as a substitute for the power semiconductor device(s) 30. This facilitates providing the rigidity of the entire package apparatus 100.

Figure 10:
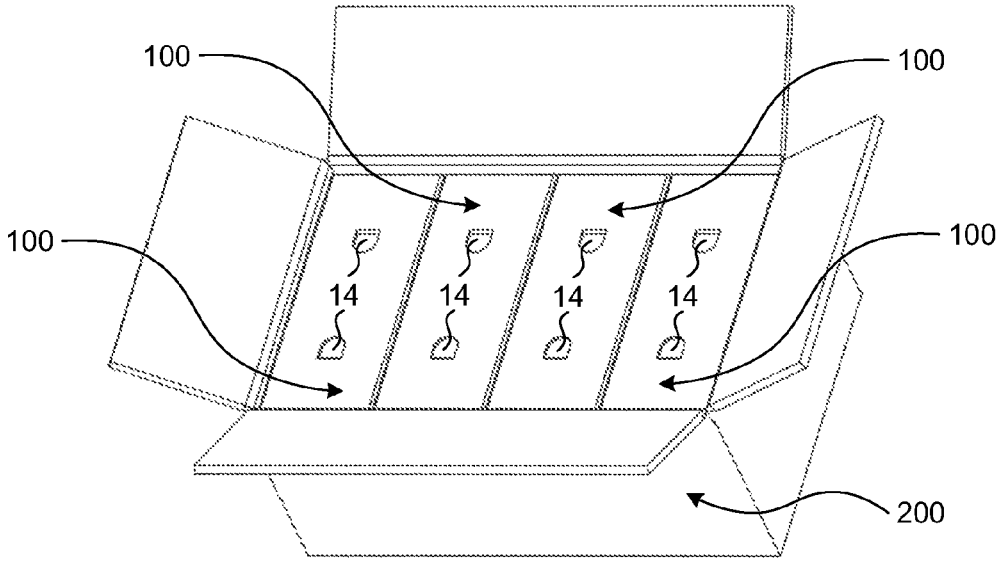
FIG. 10 is a perspective view where a plurality of package apparatuses of a power semiconductor device are packed together in a corrugated cardboard box.

FIG. 10 is a perspective view where a plurality of package apparatuses 100 of a power semiconductor device 30 are packed together in a corrugated cardboard box. If a plurality of package apparatuses 100 are packed together into a corrugated cardboard box 200 with no gap between the package apparatuses 100, it becomes difficult to pull out each package apparatus 100 when unpacked. The container box 10 constituting the package apparatus 100 of the present first embodiment has pullout holes 14. The package apparatuses 100 can thus be pulled out easily with fingers or the like in the pullout holes 14. This can improve the unpacking and packing workability.

The package apparatuses 100 are packed into the corrugated cardboard box 200 with the electrode terminals 34 and 35 of the power semiconductor devices 30 toward the top panel of the corrugated cardboard box 200. Consequently, if, for example, a falling accident happens to the packed corrugated cardboard box 200 during a cargo handling operation, the electrode terminals 34 and 35 can be protected from the impact from the bottom of the corrugated cardboard box 200.

It should be noted that the package apparatus 100 may be made not only of corrugated cardboard but also of cardboard, corrugated plastic cardboard material, and the like. In order to prevent the power semiconductor devices 30 from being electrostatically broken by static electricity in the package apparatus 100, a conductive material may be applied or otherwise provided to the plate material of the package apparatus 100 for electrical conductivity. A rustproof treatment may be applied to the plate material of the package apparatus 100 so that the metal parts of the power semiconductor devices 30 are prevented from deterioration when the package apparatus 100 packed is stored in high-humidity environment.

Second Embodiment

Figure 11:
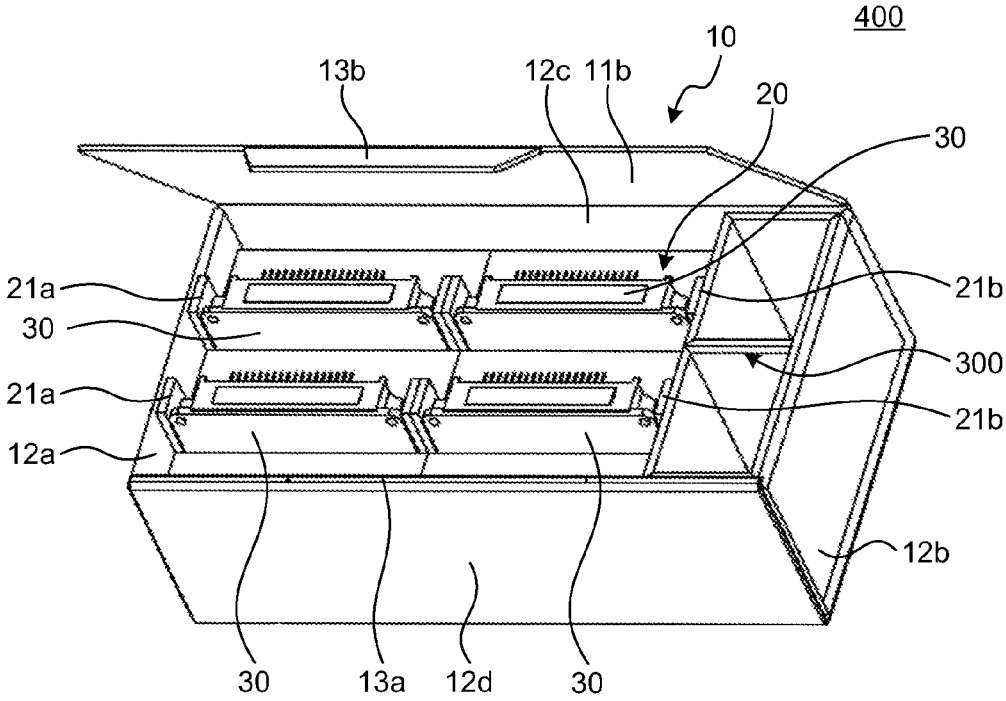
FIG. 11 is a perspective view of a package apparatus according to the present second embodiment.

FIG. 11 shows a perspective view of a package apparatus 400 according to the present second embodiment.

The same configurations as in the first embodiment will be designated by like reference signs, and a description thereof will be omitted. In the present second embodiment, power semiconductor devices 30 and other accessories can be packed together in the package apparatus 400.

The package apparatus 400 includes an accessory containing unit 300 which is contained in the container box 10 in addition to the holding unit 20. The container box 10 is formed to have inner dimensions greater than the outer dimensions of the holding unit 20. The accessory containing unit 300 is formed to have outer dimensions generally the same as a gap that is formed when the holding unit 20 is contained in the container box 10. The accessory containing unit 300 is contained in the gap that is formed when the holding unit 20 is contained in the container box 10. This can fix the holding unit 20 to suppress looseness, and allows accommodation of accessories of power semiconductor devices 30 such as mounting screws and manuals. The accessory containing unit 300 can also function as a partition to prevent scattering of the accessories in the package apparatus 100 and avoid breakage due to contact of the power semiconductor devices 30 with the accessories.

INDUSTRIAL APPLICABILITY

As has been described above, the package apparatus according to the present invention is useful in transporting power semiconductor devices.

REFERENCE SIGNS LIST

10 CONTAINER BOX
11*b* LID
12*a* to 12*d* PERIPHERAL WALL PLATE
13*a* INSERTION SLOT
13*b* INSERT TAB
14 PULLOUT HOLE
20 HOLDING UNIT
21*a*, 21*b*, 21*e*, 21*f* SIDE PLATE
22*a* to 22*d* INSERTION SLOT
23*a*, 23*h* END
25*a* to 25*f* HATCHED PORTION
26*a* to 26*i* INTERVAL MAINTAINING PLATE
30 POWER SEMICONDUCTOR DEVICE
31 SUBSTRATE
32 MOUNTING HOLE
33 MOLD PART
33*a* ELECTRODE FACE
33*b* to 33*e* PERIPHERAL SURFACE
34, 35 ELECTRODE TERMINAL
40 SPACER
100 PACKAGE APPARATUS
200 CORRUGATED CARDBOARD BOX
300 ACCESSORY CONTAINING UNIT
400 PACKAGE APPARATUS

The invention claimed is:

1. A package apparatus for packaging at least one power semiconductor device, the power semiconductor device including a substrate formed in a square shape, a mold part molded on the substrate in a square thick plate-like shape, and a plurality of electrode terminals extending from the mold part to a side opposite from the substrate by a predetermined length, the package apparatus comprising:

a holding unit that has a plurality of insertion slots that are each configured to hold a power semiconductor device, the insertion slots each being an opening into which the power semiconductor device is insertable in a direction generally perpendicular to an extending direction of the electrode terminals, edges of the opening being formed so as to make contact with the mold part and the substrate; and a container box that contains the holding unit, wherein the holding unit further includes an interval maintaining plate that makes contact with at least either one of the substrate and an electrode face from which the electrode terminals extend, and constitutes part of the edges of the openings, is formed with a width greater than the extending length of the electrode terminals, and maintains an interval between the plurality of insertion slots in the extending direction of the electrode terminals to be greater than the extending length of the electrode terminals.

2. The package apparatus according to claim 1, wherein:

the holding unit further includes a plurality of side plates that constitute part of the edges of the openings and make contact with the mold part from both sides in a direction perpendicular to the electrode face; and the holding unit is formed by folding a piece of plate member so that the plurality of side plates are linked by the interval maintaining plate.

3. The package apparatus according to claim 1, further comprising an accessory containing unit that is contained in a gap formed between an inner wall of the container box and the holding unit when the holding unit is contained, thereby fixing the holding unit in position in the container box and allowing accommodation of a member other than the power semiconductor device in the gap.

4. The package apparatus according to claim 1, wherein electrical conductivity is given to at least either one of the holding unit and the container box in order to prevent the power semiconductor device from being electrostatically broken by static electricity.

5. The package apparatus according to claim 1, wherein the container box has a pullout hole for facilitating pulling out the package apparatus from a box in which the package apparatus is contained for transportation purpose.

6. The package apparatus according to claim 1, further comprising a spacer to be inserted into any one of the plurality of insertion slots in which the power semiconductor device is not inserted.

7. The package apparatus according to claim 1, wherein the plurality of insertion slots are each provided to the holding unit so that the electrode terminals of a power semiconductor device secured in one of the insertion slots extend beyond the one insertion slot in the extending direction of the electrode terminals.

* * * * *